United States Patent [19]

Tikes

[11] 4,358,744

[45] Nov. 9, 1982

[54] IMPEDANCE MATCHED DIELECTRIC WINDOW

[75] Inventor: Jacques Tikes, Paris, France

[73] Assignee: Thomson-CSF, Paris, France

[21] Appl. No.: 215,795

[22] Filed: Dec. 12, 1980

[30] Foreign Application Priority Data

Dec. 18, 1979 [FR] France ..... 79 30937

[51] Int. Cl.[3] ..... H01P 1/08; H01P 5/02

[52] U.S. Cl. ..... 333/33; 333/252

[58] Field of Search ..... 333/35, 252, 33

[56] References Cited

U.S. PATENT DOCUMENTS 3,439,296 4/1969 Buckley ..... 333/252

3,593,224 7/1971 Eggers et al. ..... 333/252

*Primary Examiner*—Paul L. Gensler

*Attorney, Agent, or Firm*—Roland Plottel

[57] ABSTRACT

The microwave window is inserted in a rectangular waveguide and is constituted by a half-wave impedance transformer, the wavelength considered being such as to correspond to the central frequency $F_0$ for which the window has been realized; a dielectric plate of small thickness is mounted above the transformer and two inductive shutters are located on each side of the plate. The dimensions of the window components are so determined that in the case of a matched waveguide, the standing-wave ratio of the window is substantially 1 in a frequency band of at least 35% of the central frequency around the central frequency.

11 Claims, 10 Drawing Figures

FIG. 1 "PRIOR ART"
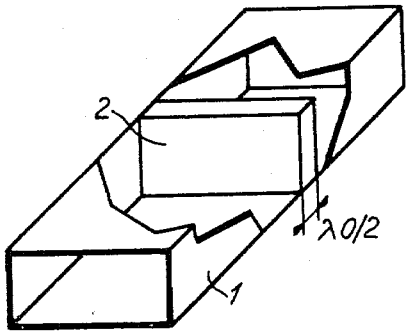
FIG. 2 "PRIOR ART"
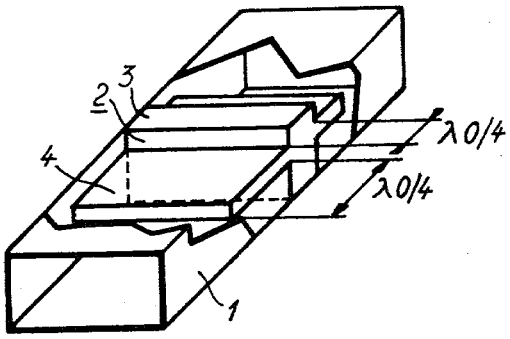
FIG. 3 "PRIOR ART"
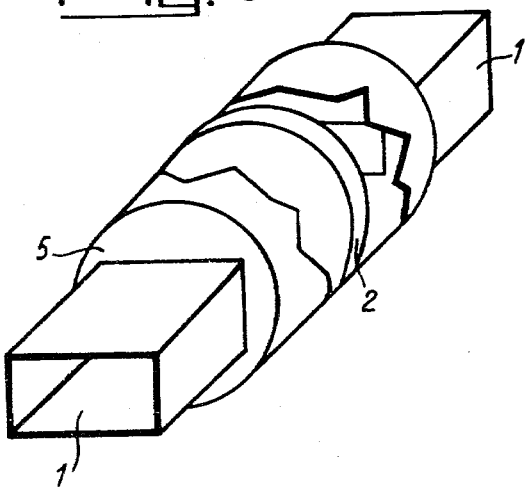
"PRIOR ART"
FIG. 4
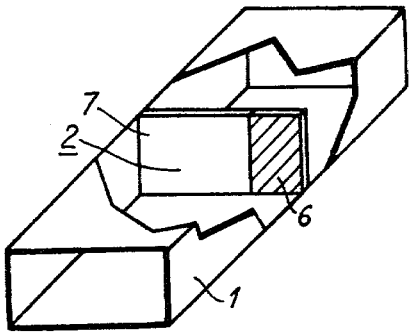

IMPEDANCE MATCHED DIELECTRIC WINDOW

This invention relates to microwave windows and is also concerned with waveguides provided with windows of this type.

A microwave device designed for operation at a pressure which is different from atmospheric pressure usually entails the need for a pressure-tight window having the double function of insulating the device from the external atmospheric pressure and permitting the propagation of microwaves without producing either reflections or internal resonances. These requirements apply, for example, to:

microwave tubes and particle accelerators which operate at substantially zero pressures;

circulators, insulators, coaxial lines and waveguides in which a gas may be trapped in order to increase their power-level maintenance capability. The pressure of said gas may attain 3 kg/cm$^2$.

A microwave window must therefore have sufficient strength to withstand a pressure of 1 kg/cm$^2$ when it is associated with a microwave device which operates at low pressure and to withstand a pressure of 3 kg/cm$^2$ when it is associated with a device which operates at high pressure.

Furthermore, it must be possible to use a microwave window over a wide frequency band in which it does not exhibit internal resonances known as ghost modes, in which it has a low standing-wave ratio and then reflections occur only to a limited extent.

This invention is more particularly concerned with microwave windows employed in rectangular-section waveguides, but the windows in accordance with the invention can also be employed in waveguides having any cross-section such as cylindrical or elliptical, for example.

Various types of windows employed in rectangular-section waveguides are known in the prior art.

Waveguide windows can be made solely of dielectric material, in which case they can comprise:

either a dielectric plate having a thickness $\lambda_o/2$ which occupies the entire cross-section of the waveguide, where $\lambda_o$ is the wavelength corresponding to the central frequency $F_0$ for which the window has been realized, or a dielectric plate having a thickness $\lambda_o/4$ which occupies the entire cross-section of the waveguide and is extended at the center by two lateral portions having an electrical length $\lambda_o/4$ which occupy approximately one-third of the total height of the waveguide;

or a simple thin dielectric plate in a circular waveguide section which is coupled to the rectangular waveguide.

Said windows can also be constituted by an inductive shutter and by a dielectric plate having a small thickness which is substantially equal to that of the shutter.

In the prior art, the windows employed in rectangular-section waveguides suffered from a disadvantage in that they had a very narrow operating frequency band. This defect is essentially due to the presence of ghost modes in the case of windows having a large volume of dielectric material and to a low standing-wave ratio in the case of windows provided with an inductive shutter and a dielectric plate since matching can be achieved only in respect to a given frequency.

Thus in the case of windows in accordance with the prior art, the operating bandwidth is usually of the order of 10 to 20% of the central frequency with respect to the central frequency with a standing-wave ratio either lower than or equal to 1:15.

The windows in accordance with the invention are not subjected to the disadvantages outlined in the foregoing.

The microwave window in accordance with the invention is constituted by:

a half-wave impedance transformer, the wavelength considered being such as to correspond to the central frequency $F_0$ for which the window has been realized, at least one inductive shutter mounted above the half-wave transformer at its middle, the remainder of the window being constituted by at least one dielectric plate having a small thickness which is substantially equal to that of the shutter.

The dimensions of the window components are so determined that, in the case of a matched microwave device, the standing-wave ratio of the window is substantially equal to one in a frequency band of at least 35% of the central frequency around the central frequency.

In a preferred embodiment of the invention, two inductive shutters which may or may not have equal dimensions are mounted above the transformer at the center thereof and are located on each side of a dielectric plate.

The advantage of the windows in accordance with the invention lies in the fact that they do not exhibit any internal resonances throughout the normal operating band of the waveguide at the fundamental mode. By virtue of this feature, the operating bandwidth with respect to the center frequency can be multiplied by 2 or 3 in comparison with windows of the prior art, the standing-wave ratio being lower than 1:10.

These and other features of the invention will be more apparent to those skilled in the art upon consideration of the following description and accompanying drawings, wherein:

FIGS. 1 to 4 are views in perspective showing windows employed in the prior art in rectangular-section waveguides;

In the different figures, the same elements are designated by the same reference numerals. For reasons of clarity, however, the dimensions and proportions of the different elements have not been observed, the hidden edges are not all shown in dashed lines and section planes are not all hatched.

FIGS. 1 to 4 are perspective views of windows employed in the prior art in rectangular-section waveguides and discussed earlier. In these figures, a cut-away portion shows the position of the window 2 within the waveguide 1.

Figure 5:
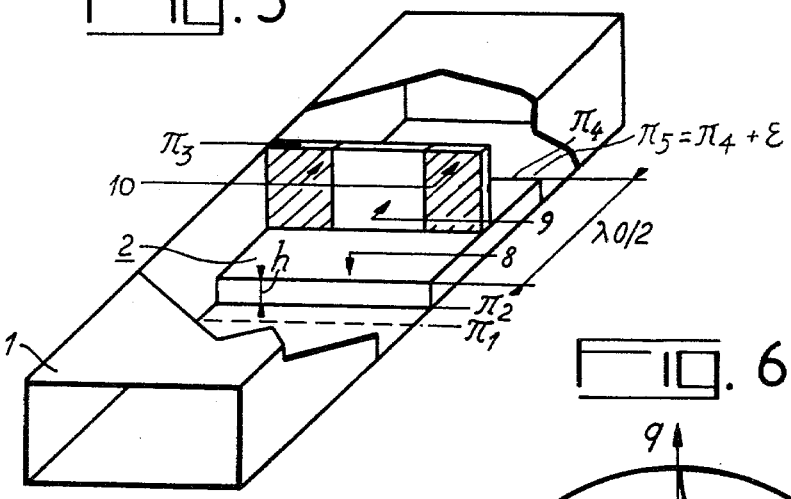
FIG. 5 is a view in perspective showing one embodiment of a window according to the invention and employed in a rectangular-section waveguide.

In FIG. 1, the window 2 consists of a dielectric plate having a thickness $\lambda_o/2$ and a rectangular cross-section. Said plate is placed at right angles to the sides of the waveguide and is bonded to said sides, usually by brazing.

In FIG. 2, the window 2 consists of a dielectric plate 3 having a thickness $\lambda_o/4$ which occupies the entire cross-section of the waveguide and is provided at the center with two lateral portions 4 which also have an electrical length $\lambda_o/4$. The lateral portions 4 occupy approximately one-third of the total height of the waveguide.

In FIG. 3, the window 2 consists of a simple dielectric plate of small thickness which is inserted in a circular waveguide section 5 coupled to the rectangular waveguide 1.

Finally, the window 2 shown in FIG. 4 is constituted by an inductive shutter 6 and a dielectric plate 7 having a small thickness which is substantially equal to that of the shutter. In FIG. 4, the inductive shutter has been shown more distinctly by means of surface hatchings.

It is known that an inductive shutter consists of a metallic plate of small thickness and placed within the waveguide cross-section at right angles to the narrow sides of the guide.

FIG. 5 is a view in perspective showing one embodiment of a window according to the invention and employed within a rectangular-section waveguide 1.

Said window 2 is constituted by a half-wave impedance transformer 8 in which the half-wavelength is designated as $\lambda_o/2$. The wavelength $\lambda_o$ corresponds to the central frequency $F_0$ for which the window has been realized.

In the figure, the transformer 8 is formed by a metallic plate which covers one of the broad sides of the waveguide over about a half-wavelength $\lambda_o/2$.

The window 2 is thus constituted by a thin dielectric plate 9 located between two inductive shutters 10 having the same dimensions.

The dielectric plate and the shutters have substantially the same thickness and are placed on the transformer at its middle, at right angles to the surface of the transformer and to three sides of the waveguide.

The plate and the shutters have rectangular cross-sections and the assembly constituted by the transformer surmounted by the plate and the shutters closes the waveguide hermetically.

Figure 6:
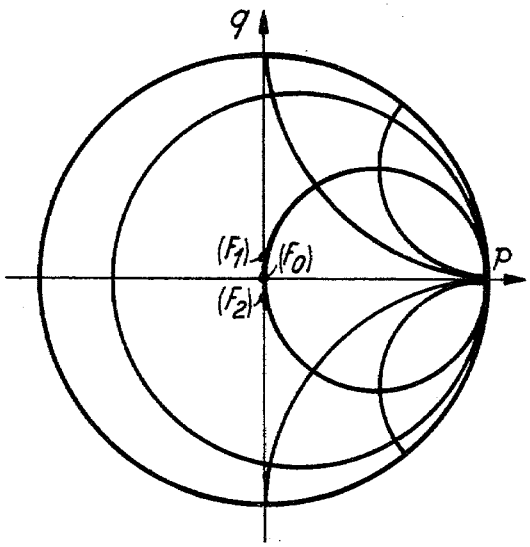
FIGS. 6 to 8 are Smith charts which illustrate the operation of a window in accordance with the invention.
Figure 7:
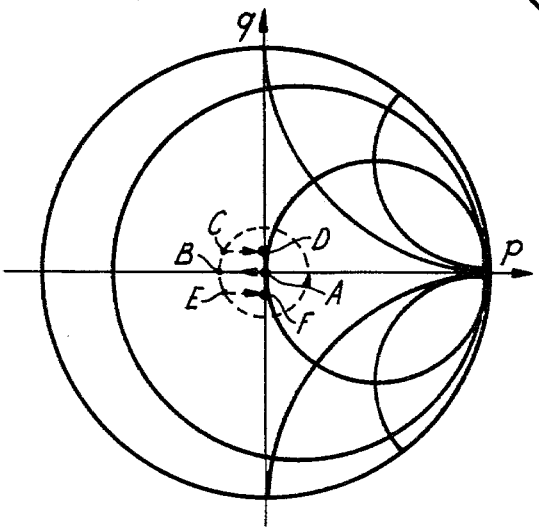
Figure 8:
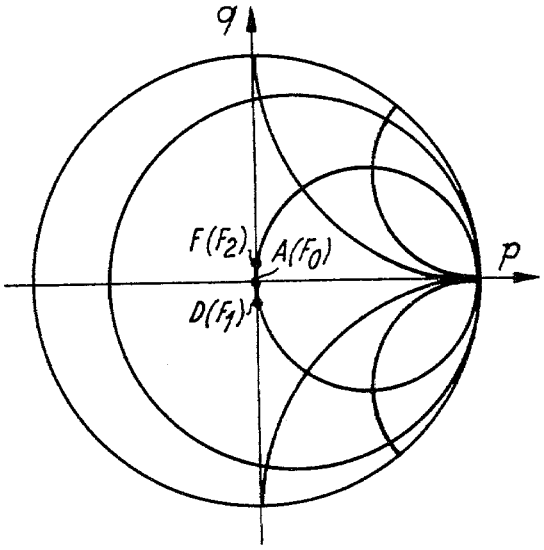

FIGS. 6 to 8 are Smith charts which illustrate the operation of a window of the type shown in FIG. 5.

In FIG. 6, there have been shown on the Smith chart the variations in the frequency band $F_1$ $F_2$, centered on $F_0$ of the impedance presented by the assembly consisting of the plate 9 and the two shutters 10.

The impedance of said assembly is a pure reactance. When the requisite thickness of the plate and shutters has been chosen in order to obtain the desired strength and rigidity, the respective surfaces of the plate and of the shutters are chosen so as to ensure that said reactance, which passes progressively through positive values, zero values and negative values in the direction of increasing frequencies from $F_1$ to $F_2$, falls to zero in respect to the frequency $F_0$.

The variations in impedance of the assembly consisting of the plate 9 and the two shutters 10 are therefore represented on the Smith chart by a straight-line segment carried by the axis of impedances q of the Smith chart; this straight-line segment is located in the half-plane of the positive impedances in respect of the frequency $F_1$, passes through the center of the Smith chart in respect of the frequency $F_0$ and is then located in the half-plane of the negative impedances in respect of $F_2$.

In FIG. 7, there are shown on the Smith chart the variations in impedance presented by the transformer alone which is connected to a matched termination at different points of the waveguide in respect of the frequencies $F_1$, $F_0$ and $F_2$.

The following notations are employed:

$\pi_1$: a waveguide plane located next to the generator and before the transformer;

$\pi_2$: the input plane of the transformer;

$\pi_3$: the midplane of the transformer;

$\pi_4$: the output plane of the transformer;

$\pi_5$: a waveguide plane located towards the matched termination just after the transformer. These different planes are indicated in FIG. 5.

Matching is achieved in the plane $\pi_1$ and, irrespective of the frequency, the impedance is represented by the point A which is the center of the Smith chart.

Arrival at the plane $\pi_2$ implies a purely resistive impedance irrespective of the frequency and the impedance is represented by the point B to the left of the point A on the axis p of resistances of the Smith chart.

A displacement from plane $\pi_2$ to plane $\pi_4$ over a length $\lambda_o/2$ results in rotation in a circle of radius AB which is centered at the point A in the trigonometric direction. The angle of rotation is dependent on the operating frequency: said angle is $2\pi$ in the case of $F_0$, $2\pi\cdot(F_1/F_0)$ in the case of $F_1$, and $2\pi\cdot(F_2/F_0)$ in the case of $F_2$.

In the plane $\pi_4$, the impedance is therefore represented by the point C, located on the circle above the point B, in respect of $F_1$. The impedance is represented by the point B in respect of $F_0$ and by the point E, located on the circle below the point B, in respect of $F_2$.

Finally, in the plane $\pi_5$, the transformer is crossed and there is an increase in purely resistive impedance which compensates for the reduction which had taken place in the plane $\pi_2$.

The impedance in plane $\pi_5$ is therefore represented at the frequencies $F_1$, $F_0$ and $F_2$ by the points D, A and F which are substantially aligned on the axis q. The points D and F are located on each side of A.

The impedance in the median plane $\pi_3$ which is distant from $\pi_4$ by $(\lambda_o/4)$ is deduced from the impedance in plane $\pi_5$ by a rotation of the straight-line segment DAF through 180°.

FIG. 8 represents on the Smith chart the variations in impedance in the plane $\pi_3$. In the plane $\pi_3$, the impedance of the transformer is therefore a reactance which successively assumes negative values, zero values and positive values in the direction of increasing frequencies from $F_1$ to $F_2$, and from D towards F.

By comparing FIGS. 6 and 8, it is observed that the variations within the frequency band $F_1$ $F_2$ of the impedance of the transformer and of the assembly constituted by the window and the shutters are purely reactive and take place in the opposite direction as a function of the frequency.

The window in accordance with the invention comprises both a transformer and an assembly constituted by two shutters and a dielectric plate mounted above the transformer at the center line of this latter. In accordance with the invention, the dimensions of the window components are so determined that the impedance of the transformer and the impedance of the assembly constituted by the window and the shutters are compensated within a frequency band $F_1$ $F_2$ of at least 35% of $F_0$ around $F_0$. Matching is therefore archieved and the standing-wave ratio is substantially equal to 1 within the band $F_1$ $F_2$.

As already stated in the foregoing, the thickness of the plate and of the shutters is usually chosen first in order to obtain the desired rigidity.

The respective surface areas of the plate and of the shutters are then chosen so as to ensure that the reactance of the plate and shutter assembly falls to zero in respect of the frequency $F_0$. The height h of the transformer is finally determined. This height governs the radius AB of the circle centered at A, in which there takes place a rotation of $2\pi$, $2\pi$ $F_1/F_0$ and $2\pi$ $F_2/F_0$, thus making it possible to obtain the points C, B, E and then the points DAF. The height h of the transformer is therefore chosen so as to ensure that the segment DAF obtained in FIG. 8 is symmetrical with the segment shown in FIG. 6 with respect to the center of the chart.

A window in accordance with the invention has been tested in a rectangular-section waveguide having dimensions of 72×34 mm. The thickness of the dielectric plate was 2 mm and the thickness of the shutter was 3 mm. It has been found that no internal resonances appeared throughout the operating frequency band of the waveguide within the range of 2.6 to 3.95 GHz.

A standing-wave ratio which is lower than or equal to 1.08 was obtained for an operating bandwith $F_1$ $F_2$ of 35% of $F_0$ around $F_0$. The operating band could exceed 40% of $F_0$ around $F_0$ with a standing-wave ratio of 1.5 and 50% of $F_0$ around $F_0$ with a standing-wave ratio below 2.

Figure 9:
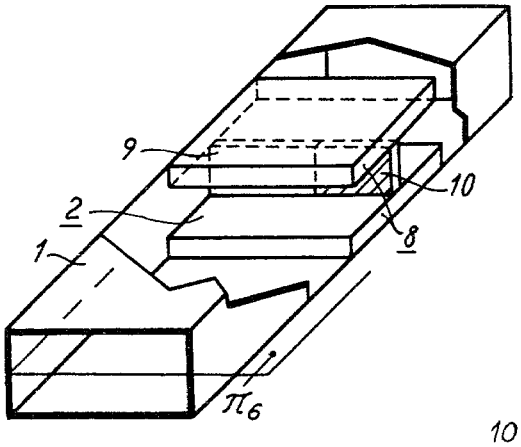
FIGS. 9 and 10 represent two further embodiments, these figures being views in perspective showing a window in accordance with the invention and employed in a rectangular-section waveguide.
Figure 10:
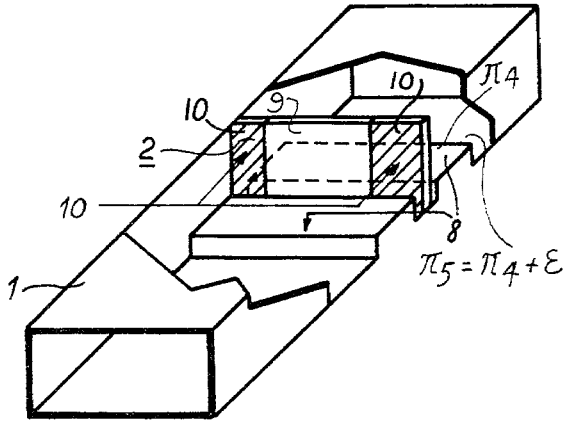

FIGS. 9 and 10 are perspective views of two other embodiments of a window in accordance with the invention which is employed in a rectangular-section waveguide and the operation of which is identical with that of the window shown in FIG. 5.

In FIG. 9, the transformer is constituted by two metallic plates which are located in oppositely-facing relation and cover the two broad sides of the waveguide over about the half-wavelength ($\lambda_o/2$).

These metallic plates do not necessarily have the same thickness.

The half-wave transformer can also be constructed by reducing the height of the waveguide over about the half-wavelength ($\lambda_o/2$), whether symmetrically or not with respect to the longitudinal midplane of the waveguide $\pi_6$ (shown in FIG. 9).

Similarly, the assembly which is mounted above the transformer at the middle of this latter can be constituted by a dielectric plate 9 and a single inductive shutter 10 as shown in FIG. 9.

The window in accordance with the invention can also comprise an assembly consisting of a dielectric plate surrounded by two inductive shutters having different surface areas.

Finally, the inductive shutters can be formed by a metallic plate or by a metallic deposit which covers to a partial extent one or both faces of the dielectric plate which constitutes the window, in which case said dielectric plate takes up the entire cross-section of the waveguide above the transformer.

In FIG. 10, the transformer 8 is formed by producing a dissymmetrical reduction in the height of the waveguide and is provided with a discontinuity at its middle. The assembly consisting of a dielectric plate 9 and two inductive shutters 10 of unequal area then rests directly on the waveguide walls. Better power-level maintenance capability is thus obtained.

In practice, a window in accordance with the invention as illustrated in FIG. 5 is fabricated in several steps.

The initial step consists of separate fabrication of the assembly consisting of the dielectric plate 9 and the inductive shutters 10.

To this end, a copper strip of small thickness (approximately 2 mm in the case of a window operating in the S-band and referred-to in the foregoing) is joined by brazing to the periphery of a dielectric strip 9 of ceramic material. Said copper strip is brazed at the same time to a molybdenum band, the shape of which is studied with a view to forming the inductive shutters 10.

The plate-shutter assembly is then brazed to the junction of two half-waveguides whilst the two half-waveguides are brazed together at the same time.

A half-transformer 8 has previously been brazed onto each half-waveguide mentioned above.

As will readily be apparent, the foregoing constitutes only one example of construction of a window in accordance with the invention.

What is claimed is:

1. A microwave window in a microwave device, wherein said window comprises:

a half-wave impedance transformer, whose wavelength corresponds to the central frequency of the window;

the remainder of the window being constituted by at least one inductive shutter and one dielectric plate, said dielectric plate having a small thickness substantially equal to the thickness of said shutter, said inductive shutter and said dielectric plate being mounted above the half-wave transformer at its middle and the assembly constituted by said transformer surmounted by said plate and said shutter closing the microwave device hermetically;

the dimensions of the window being so determined that in the case of a matched microwave device, the standing-wave ratio of the window is substantially equal to one in a frequency band of at least 35% of the central frequency.

2. A window according to claim 1, wherein said window is constituted by two inductive shutters which are located on each side of said dielectric plate.

3. A window according to claim 2, wherein the two shutters have equal dimensions.

4. A window according to claim 1 wherein said window is formed by brazing a strip of copper of small thickness both to the dielectric plate of ceramic material and to a molybdenum band which constitutes the inductive shutter.

5. A window according to claim 1 wherein the inductive shutter is formed by a metallic deposit partly covering at least one face of the dielectric plate which constitutes the window.

6. A window according to claim 1, wherein the half-wave transformer has a discontinuity in the central portion thereof and wherein the inductive shutter and the dielectric plate rest directly on the walls of the microwave device.

7. A microwave window according to claim 1 wherein the microwave device comprises a waveguide having any desired section.

8. A waveguide according to claim 7, wherein the window is brazed to the junction of two half-waveguides whilst said half-waveguides are brazed together at the same time, each half-waveguide being already provided with a half-transformer.

9. A microwave window according to claim 7, wherein the waveguide has a rectangular section and the half-wave transformer is fabricated from a metallic plate which covers at least one of the broad sides of the waveguide over about the half-wavelength.

10. A microwave window according to claim 7, wherein the waveguide has a rectangular section and the half-wave transformer is fabricated by reducing the height of the waveguide over about the half-wavelength, with respect to the longitudinal midplane.

11. A microwave window according to claim 10, wherein the height of the waveguide is reduced symmetrically with respect to the longitudinal midplane.

* * * * *